US007231884B1

(12) United States Patent
Rang

(10) Patent No.: US 7,231,884 B1
(45) Date of Patent: Jun. 19, 2007

(54) PENNANT DISPLAY WITH POLE MOUNTABLE COLLAR

(76) Inventor: Corey Rang, 1900 S. Emerson Ave., Gillette, WY (US) 82718

( * ) Notice: Subject to any disclaimer, the term of this patent is extended or adjusted under 35 U.S.C. 154(b) by 0 days.

(21) Appl. No.: 11/230,037

(22) Filed: Sep. 19, 2005

(51) Int. Cl.
*G09F 17/00* (2006.01)

(52) U.S. Cl. ..... 116/173; 116/174; 40/218

(58) Field of Classification Search ..... 116/173–175, 116/28 R, 35 R, 42, DIG. 36; D12/181–182, D12/166; 40/590–591, 218, 643
See application file for complete search history.

(56) References Cited

U.S. PATENT DOCUMENTS

| | | | | | |
|---|---|---|---|---|---|
| 394,983 | A | * | 12/1888 | Hurley | 116/173 |
| 1,396,787 | A | * | 11/1921 | Shepard | 116/173 |
| 2,345,621 | A | | 4/1944 | Mothershead | |
| 2,440,500 | A | | 4/1948 | Ellis | |
| 2,630,779 | A | | 3/1953 | Mader | |
| 2,672,118 | A | | 3/1954 | Martin | |
| 2,711,712 | A | * | 6/1955 | Reed, Jr. | 116/174 |
| 3,587,520 | A | * | 6/1971 | Miller | 116/173 |
| 3,595,202 | A | | 7/1971 | Visitacion | |
| 3,958,116 | A | | 5/1976 | Jones | |
| 4,730,803 | A | | 3/1988 | Hillstrom | |
| 5,120,102 | A | * | 6/1992 | Cumbie | 296/3 |
| 5,465,957 | A | * | 11/1995 | Schroeder | 473/484 |
| 5,568,784 | A | * | 10/1996 | Willis et al. | 116/173 |
| 5,694,733 | A | * | 12/1997 | Gallemore, II | 52/736.2 |
| 6,484,992 | B1 | * | 11/2002 | Svensson et al. | 248/320 |
| 6,547,197 | B2 | * | 4/2003 | Kempf et al. | 248/218.4 |
| 6,748,683 | B1 | * | 6/2004 | Schultz | 40/218 |
| 6,789,496 | B2 | * | 9/2004 | Gehris | 116/173 |
| 6,923,141 | B1 | * | 8/2005 | Staats et al. | 116/173 |

FOREIGN PATENT DOCUMENTS

| | | |
|---|---|---|
| DE | 10311703 | 3/2003 |
| ES | 2.020.452 | 8/1991 |
| FR | 2.596.185 | 9/1987 |

* cited by examiner

*Primary Examiner*—Richard Smith
*Assistant Examiner*—Tania Courson
(74) *Attorney, Agent, or Firm*—Michael I. Kroll

(57) ABSTRACT

A pennant display system comprising a cuff positioned on a structure having predetermined height and means connected to the cuff for moving the cuff along the height of the structure. The system further comprises means positioned on each of the cuff and the moving means for releaseably attaching a pennant thereto.

16 Claims, 11 Drawing Sheets

PENNANT DISPLAY WITH POLE MOUNTABLE COLLAR

BACKGROUND OF THE INVENTION

1. Field of the Invention

The present invention relates generally to flagstaffs and, more specifically, to a system for connection to an existing structure such as a light post or the like, and means to raise, and lower a pennant from the structure. A pennant pole is pivotally attached to a slide bracket and allows the slide bracket to move up and down the structure. The pennant pole includes a means, such as washer rings, for releasably attaching a pennant. The system includes a locking means to keep the pennant pole stable while displaying the pennant.

2. Description of the Prior Art

There are other flag and pennant displaying devices. Typical of these is U.S. Pat. No. 2,345,621 issued to R. E. Mothershead on Apr. 4, 1944.

Another patent was issued to R. Ellis on Apr. 27, 1948 as U.S. Pat. No. 2,444,500. Yet another U.S. Pat. No. 2,630,779 was issued to J. Mader on Mar. 10, 1953 and still yet another was issued on Mar. 16, 1954 to E. L. Martin as U.S. Pat. No. 2,672,118.

Another patent was issued to Judson O. Miller on Jun. 28, 1971 as U.S. Pat. No. 3,587,520. Yet another U.S. Pat. No. 3,595,202 was issued to Aniceto R. Visitacion on Jul. 27, 1971. Another was issued to Clifton E. Jones on May 18, 1976 as U.S. Pat. No. 3,958,116 and still yet another was issued on Mar. 15, 1988 to David U. Hillstrom as U.S. Pat. No. 4,730,803.

Internationally, a patent was issued to Thibault Blandine on Sep. 25, 1987 as France Patent Number FR2596185. A Spain Patent No. ES2020452 was issued to Manuel Gomez Barragan on Jan. 8, 1991. Another German patent was issued to Franz Pracherstorfer on Oct. 2, 2003 as Patent No DE 10311703.

U.S. Pat. No. 2,345,621

Inventor: R. E. Mothershead

Issued: Apr. 4, 1944

This invention relates to withes or boom irons to be applied to masts, flagpoles and the like in combination with a cooperative hook for releasably engaging the improved withes or boom irons. The invention contemplates the use of a supporting collar or boom iron, herein referred to as a withe, to which suspension hooks of blocks and tackles may be elevated and brought into engagement with the withe by halyards of conventional types, operable through loops or pulleys at or near the tops of masts and flagpoles.

U.S. Pat. No. 2,444,500

Inventor: R. Ellis

Issued: Apr. 27, 1948

This invention relates to improvements in track brakes for use especially in connection with kiln cars, the primary object in view being to provide a simple form of inexpensively constructed track brake for frictionally engaging a rail of the car tracks to slow down and/or stop the travel of a kiln car running on the tracks. Other and subordinate objects, also comprehended by my invention, together with the precise nature of my improvements, and the advantages thereof, will be readily understood when the succeeding description and claims are read with reference to the drawings accompanying and forming part of this specification.

U.S. Pat. No. 2,630,779

Inventor: J. Mader

Issued: Mar. 10, 1953

The principal object of this invention is to provide a means for raising a flag on a flagpole and lowering the same from a point remote from said pole. Another object is to provide in connection with a device of this character a compartment into which the flag will be automatically moved and hung in flat, unwrinkled condition when lowered, and which will serve to protect the flag from the elements when not in use. Another object is to provide a device of this character in which the flag is raised by gravitational action but is lowered by motor driven mechanism.

U.S. Pat. No. 2,672,118

Inventor: E. L. Martin

Issued: Mar. 16, 1954

This invention relates to devices for attaching a flag and halyard arrangement to flagpoles and more particularly to devices which permit the attached flag to revolve about the flagpole according to the direction of the wind without becoming wrapped around the pole.

U.S. Pat. No. 3,587,520

Inventor: Judson O. Miller

Issued: Jun. 28, 1971

A flagpole in which a flag-carrying pole section is reversibly mounted on a base pole section, and the flag is attached to one end of the flag-carrying pole section, so that with the flag-carrying pole section mounted in one position the flag flies at top mast and with the flag-carrying pole section mounted in another position the flag flies at half-mast. In a preferred embodiment the flag-carrying pole section is rotatable relative to the base pole section.

U.S. Pat. No. 3,595,202

Inventor: Aniceto R. Visitacion

Issued: Jul. 27, 1971

A flagstaff having a relatively short axially movable sleeve which is prevented from rotating about the staff. The sleeve has a pair of spaced-apart discs on its upper end portion and a pair of spaced-apart discs on its lower end portion. A ring-shaped member is freely rotatable between the discs of each pair of discs. Each of the ring-shaped members has an arm radially extending therefrom, and a bar having several perforations is attached to the arms so that a flag may be easily hooked on the bar and thus can swing and whirl around the flagstaff without winding itself around it.

U.S. Pat. No. 3,958,116

Inventor: Clifton E. Jones

Issued: May 18, 1976

A pole shaft is provided with continuous loop drive chain means to raise and lower a luminaire ring assembly mounted thereon. A detachable fixed head assembly is provided at the top of the pole shaft and has locating and locking means for fixedly retaining the luminaire ring in its fully raised position. The detachable fixed head assembly is provided with radially extending support arms having sheaves which support lifting and lowering suspension cables that engage the luminaire ring. The suspension cables extend inside the pole shaft and operatively engage a transition plate provided in association with the continuous loop drive chain means. A motor drive assembly is provided in the base of the pole shaft which operates the continuous loop drive chain means and associated limit switch positioning means which control the amount of travel of the continuous loop drive chain. A safety lock assembly is provided on said transition plate so as to selectively engage a safety cable provided in the pole shaft in the event of failure of the continuous loop drive chain.

U.S. Pat. No. 4,730,803

Inventor: David U. Hillstrom

Issued: Mar. 15, 1988

The present invention discloses a lightweight sign-support assembly for displaying and supporting a sign in a preselected display position. The sign-supporting assembly is especially adapted for ground-access removal, installation, or changing of signs or messages in elevated pole banner-type signs. The sign supporting assembly includes a track secured to a pole, a support assembly slidably secured in the track, and a locking mechanism for positioning and releasably securing the support assembly along the track.

France Patent Number FR2596185

Inventor: Thibault Blandine

Issued: Sep. 25, 1987

The invention relates to a removable, pivoting and sliding flag support device for poles of conical tube shape or similar poles, with an internal halyard and a rotating pommel or similar devices, equally applicable to cylindrical poles. The flag is hooked onto a movable stem, drawn along the pole by sliding vertically, which stem in its upper end position then leaves its vertical guide and simultaneously is rendered integral with the rotating pommel which holds it by tension on the halyard. This stem carrying the flag is held parallel to the axis of the pole by insertion of its upper end into the underside 6 of the pommel, and by insertion of its other end into a circular horizontal rail incorporated into the pole, on the inside of which it circulates freely. This stem which is maneuverable from the bottom of the pole also follows, in its upper position, all the multiple circular fluctuations of the flag and prevents it being wound around the pole under the effect of air turbulence.

Spain Patent Number ES2020452

Inventor: Manuel Gomez Barragan

Issued: Jan. 8, 1991

Pole for flags, especially advertising flags (pennants) which have to be fixed to cranes or other dismantleable structures, which consists of at least three sections or segments of flexible rod, which are coaxial and fixed end to end so that they can rotate freely about the common axis, the first one of which includes means for fastening the assembly, whilst the last one includes a counterweight capable of keeping this assembly properly under tension, in the vertical position, the intermediate section or sections being intended for supporting the corresponding flag or flags.

Germany Patent Number DE10311703

Inventor: Franz Pracherstorfer

Issued: Oct. 2, 2003

Flagpole with a hauling device comprises a rope pull guided by rollers along the flagpole, and an extension arm for receiving a flag and fixed on a support extending along a rope shaft of the rope pull and clamped to the rope shaft. The extension arm is rotatably positioned via a rotating head on the upper end of the support. Preferred Features: A rotating pin of the rotating head engages in the top of a tubular element forming part of the support. The telescopic extension arm engages in a hollow seam of the flag. A slotted protective tube covering the hollow seam at least at the connection to the rotating head is slotted on the extension arm.

SUMMARY OF THE PRESENT INVENTION

The present invention relates generally to flagstaffs and, more specifically, to a system for connection to an existing structure such as a light post or the like, and means to raise, and lower a pennant from the structure. A pennant pole is pivotally attached to a slide bracket and allows the slide bracket to move up and down the structure. The pennant pole includes a means, such as washer rings, for releasably attaching a pennant. The system includes a locking means to keep the pennant pole stable while displaying the pennant.

A primary object of the present invention is to provide a pennant display system that overcomes the shortcomings of the prior art.

A secondary object of the present invention is to provide a pennant display system for connection to an existing structure.

Another object of the present invention is to provide a pennant display system wherein the existing structure includes but is not limited to a light post.

Still another object of the present invention is to provide a pennant display system including a mechanism for raising and lowering a pennant from the structure.

Another object of the present invention is to provide a pennant display system wherein the mechanism for raising and lowering a pennant on a structure includes a cuff.

Yet another object of the present invention is to provide a pennant display system wherein the cuff partially surrounds the structure.

Still another object of the present invention is to provide a pennant display system wherein the cuff includes but is not limited to a slide bracket.

Yet still another object of the present invention is to provide a pennant display system wherein the slide bracket has a pivotally attached pennant pole.

Yet another object of the present invention is to provide a pennant display system wherein the pennant pole provides means for raising the slide bracket up the structure.

Still another object of the present invention is to provide a pennant display system wherein the object displayed includes but is not limited to a pennant.

Still yet another object of the present invention is to provide a pennant display system wherein the pennant pole has a mechanism for releasably attaching a pennant to the pennant pole.

Another object of the present invention is to provide a pennant display system wherein the mechanism for releasably attaching a pennant to the pennant pole includes but is not limited to washer rings to releasably attach a pennant to the pennant pole.

Yet another object of the present invention is to provide a pennant display system wherein the pennant pole is anchored by a pin affixed to the pedestal of the pole structure.

Still yet another object of the present invention is to provide a pennant display system wherein the pedestal affixed pin and lower end of rod contain mating apertures for receiving at least one of a cross pin or a locking mechanism to further secure the pennant pole while in use.

Another object of the present invention is to provide a pennant display system having a stopping mechanism to prevent the slide bracket coming into contact with the bottom of the structure.

Still another object of the present invention is to provide a pennant display that is simple and easy to use.

Still yet another object of the present invention is to provide a pennant display system that is inexpensive to manufacture and operate.

Additional objects of the present invention will appear as the description proceeds.

The present invention overcomes the shortcomings of the prior art by providing a system for raising a pennant on a structure. The system includes a structure mounted slide bracket with a pivotally attached pennant pole having a pennant thereon, wherein the pennant pole allows the slide bracket to move along a height of the structure. The pennant pole includes a mechanism for releasably attaching a pennant display to the pennant pole. The slide bracket is of various shapes to accommodate the form of the structure.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
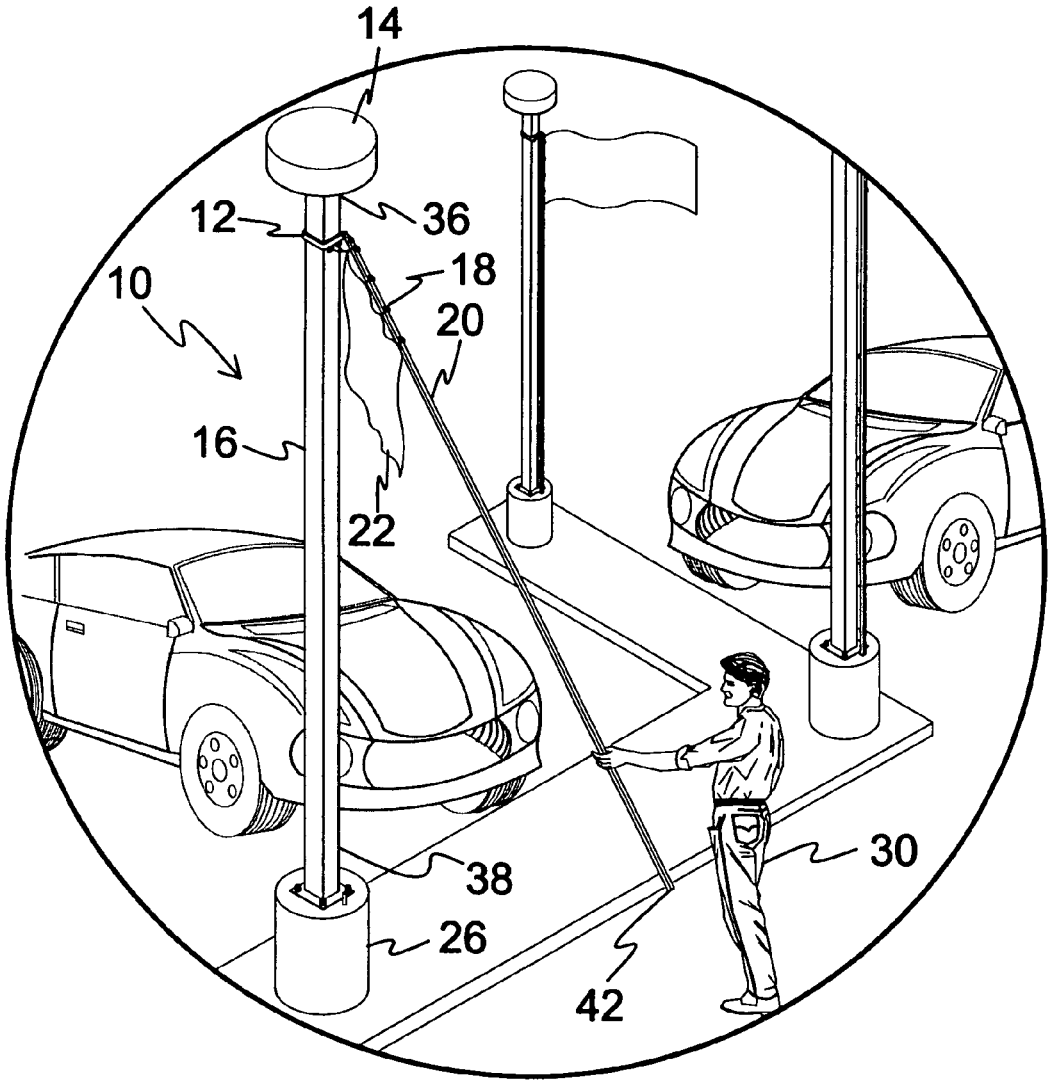
FIG. 1 is an illustrative view of the pennant display system of the present invention in use.

Turning now descriptively to the drawings, in which similar reference characters denote similar elements throughout the several views, the Figures illustrate the pennant display system of the present invention. With regard to the reference numerals used, the following numbering is used throughout the various drawing Figures.

10 Pennant display system of the present invention
12 slide bracket
14 light
16 structure
18 washers
20 pennant pole
22 pennant
24 lockable attachment pin
26 pedestal
28 pivot bolt
30 user
32 down arrow
34 arc arrow
36 structure top
38 structure bottom
40 pennant pole top
42 pennant pole bottom
44 locking mechanism
46 first locking aperture
48 second locking aperture
50 cross pin
52 slide bracket first end
54 slide bracket second end
56 first end aperture
58 second end aperture
60 pivot aperture
62 pedestal top
64 fastener

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments; practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1 through 11 illustrate a pennant display system of the present invention which is indicated generally by the reference numeral 10.

FIG. 1 is an illustrative view of the pennant display system 10 of the present invention in use. The pennant display system 10 includes a slide bracket 12 pivotally attached to a pennant pole 20. The pennant pole 20 and the slide bracket 12 each have a plurality of washers 18 attached thereto for attaching a pennant 22 thereto. Shown herein, the pennant display system 10 is being used in a parking lot. The slide bracket 12 is attached to a structure 16. The structure 16 has a light 14 at a structure top 36 and a pedestal 26 at a structure bottom 38. A user 30 is using the pennant display system 10 to lower and remove the pennant 22. The user 30 grasps the pennant pole 20 near a pennant pole bottom 42 and the pivotal attachment of the pennant pole 20 to the slide bracket 12 allows the user 30 to pivot the pennant pole 20 thereby creating an angle between the pivot pole 20 and the structure 16. Upon creation of the angle between the structure 16 and the pennant pole 20, the user 30 is able to exert a downward force on the pennant pole 20. The angular downward force causes the slide bracket 12 to slide from the structure top 36 to the structure bottom 38 thereby placing the pennant 22 at a height that can be easily reached by the user 30.

The pennant display system 10 of the present invention is advantageous in that it facilitates the raising and lowering of the pennant 22. The pennant display system 10 permits the pennant 22 to be raised and lowered without the aid of a heightening device, such as a ladder. This allows the pennant 22 to be changed without endangering the person who is changing the pennant 22. The pennant display system 10 also ensures the pennant 22 remains at a predetermined height on the structure 16 by locking the pennant pole 20 in place. In one embodiment, the pennant display system 10 includes a stopping mechanism that prevents the slide bracket 12 from coming into contact with the structure bottom 38. This prevents an object from getting caught between the slide bracket 12 and the structure bottom 38 during the descent of the slide bracket 12.

Figure 2:
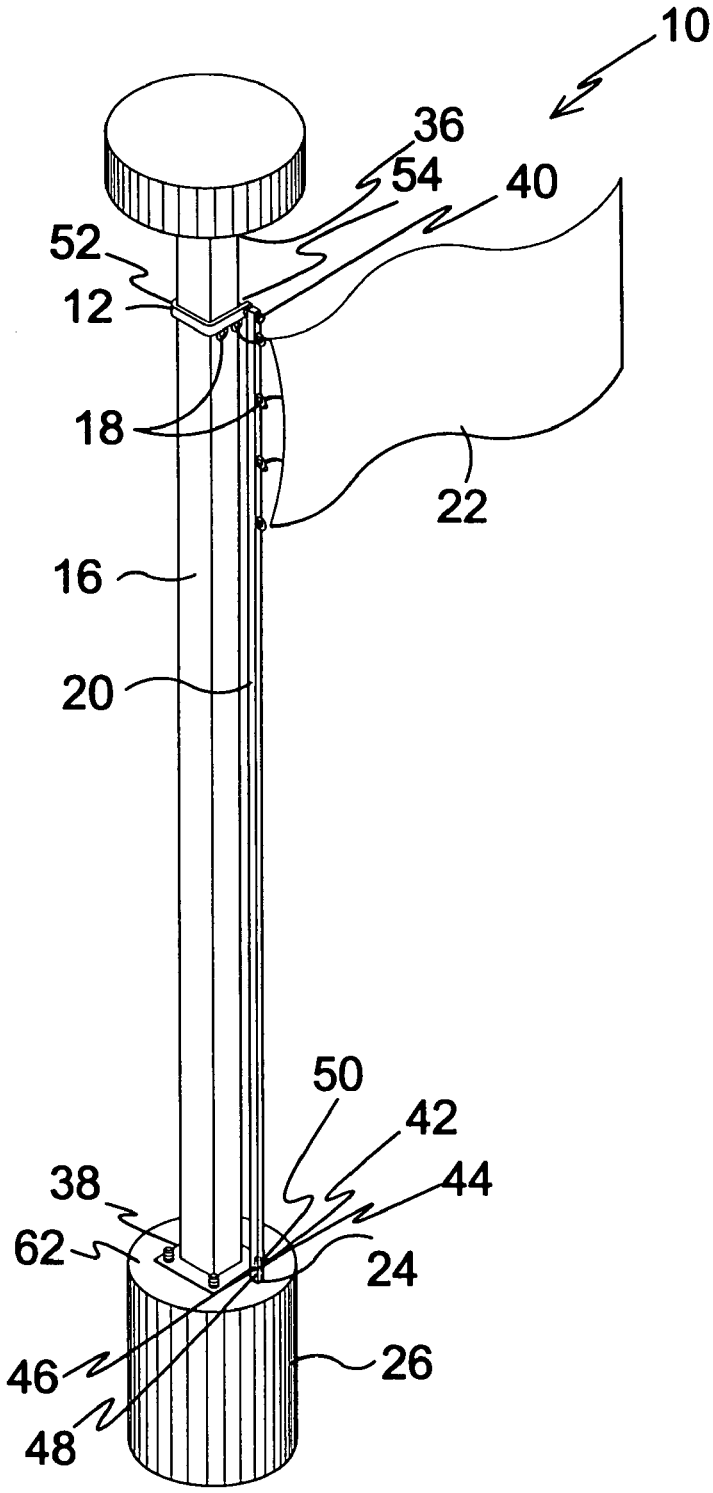
FIG. 2 is a perspective view of the pennant display system of the present invention.

FIG. 2 is a perspective view of the pennant display system 10 of the present invention. The pennant display system 10 includes the slide bracket 12 pivotally attached to the pennant pole 20. The slide bracket 12 fits around the structure 16. Shown herein, the structure 16 is shaped substantially as a square, and the slide bracket 12 is shaped to fit therearound. However, the slide bracket 12 can be made in a plurality of geometric shapes to fit around a plurality of different geometrically shaped structures 16 as will be discussed hereinafter with specific reference to FIG. 11.

The structure 16 has the top end 36 and the bottom end 38. Shown herein, the light 14 is affixed to the top end 36 of the structure. This is shown for purposes of example only and any number of objects may be affixed to the top end 36 of the structure in different embodiments of the invention. The bottom end 38 of the structure is secured to the pedestal 26. The pedestal 26 is shown for purposes of example only, and the bottom end 38 of the structure may be secured to any number of surfaces in different embodiments of the invention.

The slide bracket 12 is pivotally connected to the pennant pole 20 at a pennant pole top 40 by a pivot bolt 28, shown and further discussed hereinafter with reference to FIG. 3. The slide bracket 12 in the embodiment shown herein is "C"-shaped and includes a first end 52 and a second end 54. At least two washers 18 are located on the slide bracket 12 adjacent to the second end 54. The system 10 further includes a mechanism for pivotally connecting the pennant pole 20 to the slide bracket 12 which will be discussed hereinafter with specific reference to FIG. 3. As shown herein, the pennant pole 20 is pivotally connected adjacent to the second end 54 and is perpendicular thereto. The pennant pole 20 also includes a plurality of washers 18 extending along the pennant pole 20. As shown herein, there are at least four washers 18 disposed along the pennant pole 20, extending a predetermined distance from the pennant pole top 40. Preferably, the respective washer 18 positioned at the furthest distance from the pennant pole top 40 is positioned at a distance of no more than one quarter of the length of the pennant pole 20. This is shown for purposes of example only, and any number of washers 18 may be utilized along varied locations in different embodiments of the present invention depending on the size and type of pennant 22 to be hung. The washer 18 on each of the slide bracket 12 and pennant pole 20 allow the pennant 22 to be connected to the structure 16 for display. The pennant 22 is attached to the washer 18 by a fastener 64. Shown here, the fastener 64 is a hook. This is shown for purposes of example only, and any type of fastening device. Fasteners include but are not limited to hooks, rope, hook and loop tape and adhesives.

The pennant pole bottom 42 includes a locking mechanism 44 for securing the pennant pole bottom 42 to the pedestal 26. The pedestal 26 includes a top end 62. In the present embodiment, the locking mechanism 44 includes a lockable attachment pin 24 protruding upward from the pedestal top 62. The pennant pole bottom 42 has a section of one of the side of the pennant pole 20 removed therefrom. The section removed is substantially equal to a height of the lockable attachment pin 24 thereby allowing the lockable attachment pin 24 to be received within the pennant pole bottom 42 when an angle between the pennant pole top 40 and the slide bracket 12 is substantially equal to zero degrees. The lockable attachment pin 24 has a second locking aperture 48. The pennant pole 20 has a first locking aperture 46 extending through the pennant pole 20 at a predetermined distance from the pennant pole bottom 42. When the lockable attachment pin 24 is received within the pennant pole bottom 42, the first locking aperture 46 and the second locking aperture 48 are aligned. A cross pin 50 is provided and is inserted through both apertures 46 and 48 to secure the pennant pole 20 to the pedestal 26. This is shown for purposes of example only, and different mechanisms can be used to secure the pennant pole 20 to the pedestal 26.

Figure 3:
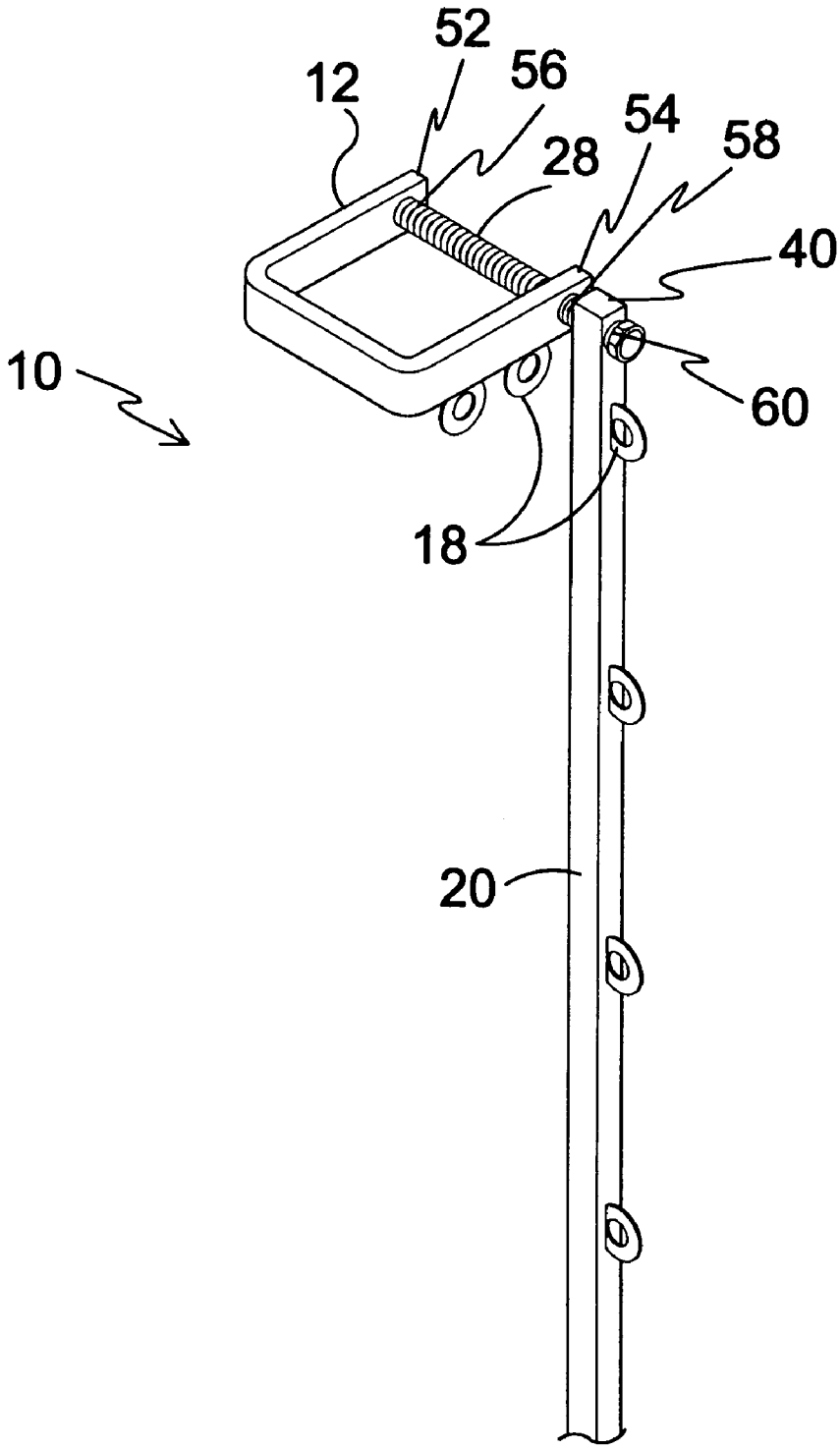
FIG. 3 is a perspective view of the pennant display system of the present invention.

FIG. 3 is a perspective view of the pennant display system 10 of the present invention. The pennant display system 10 includes the slide bracket 12 pivotally attached to the pennant pole 20. The slide bracket 12 fits around the structure 16, shown in FIG. 2. Shown herein the slide bracket 12 is shaped to fit around a structure 16 shaped substantially as a square. However, the slide bracket 12 can be made in a plurality of geometric shapes to fit around a plurality of different geometrically shaped poles 16 as will be discussed hereinafter with specific reference to FIG. 11.

The slide bracket includes the first end 52 and the second end 54. The first end 52 of the slide bracket includes a first end aperture 56. The second end 54 of the slide bracket includes a second end aperture 58. A pivot aperture 60 is located adjacent to the top end 40 of the pennant pole. When the second end aperture 58 and the pivot aperture 60 are aligned, a pivot bolt 28 is received therethrough. The pivot bolt 28 is further received by the first end aperture 52. The pivot bolt 28 pivotally attaches the pennant pole 20 to the slide bracket 12. Additionally, receipt of the pivot bolt 28 further secures the slide bracket 12 to the structure 16 as shown in FIG. 2.

At least two washers 18 are located on the slide bracket 12 adjacent to the second end 54. The system 10 further includes a mechanism for pivotally connecting the pennant pole 20 to the slide bracket 12. As shown herein, the pennant pole 20 is pivotally connected adjacent to the second end 54 and is perpendicular thereto. The pennant pole 20 also includes a plurality of washers 18 extending along the pennant pole 20. As shown herein, there are at least four washers 18 disposed along the pennant pole 20 extending a predetermined distance from the pennant pole top 40. Preferably, the respective washer 18 positioned at the furthest distance from the pennant pole top 40 is positioned at a distance of no more than one quarter of the length of the pennant pole 20. This is shown for purposes of example only, and any number of washers 18 may be utilized along varied locations in different embodiments of the present invention depending on the size and type of pennant to be hung. The washer 18 on each of the slide bracket 12 and pennant pole 20 allow the pennant 22 to be connected to the structure 16 for display.

Figure 4:
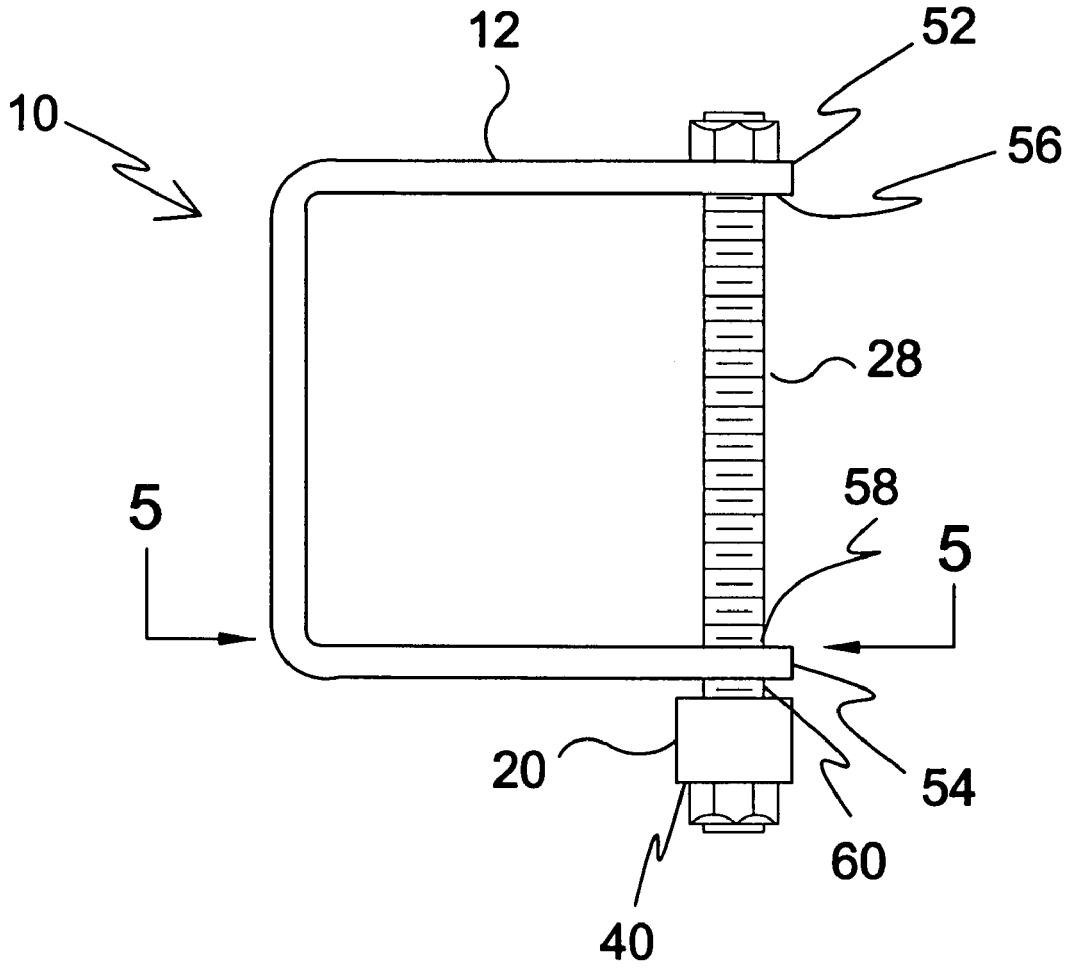
FIG. 4 is a top view of the slide bracket of the pennant display system of the present invention.

FIG. 4 is a top view of the slide bracket 12 of the pennant display system 10 of the present invention. The pennant display system 10 includes the slide bracket 12 pivotally attached to the pennant pole 20. The slide bracket 12 fits around the structure 16, shown in FIG. 2. Shown herein the slide bracket 12 is shaped to fit around a structure 16 shaped substantially as a square. However, the slide bracket 12 can be made in a plurality of geometric shapes to fit around a plurality of different geometrically shaped structures 16 as will be discussed hereinafter with specific reference to FIG. 11.

The slide bracket includes the first end 52 and the second end 54. The first end 52 of the slide bracket includes the first end aperture 56. The second end 54 of the slide bracket includes the second end aperture 58. The pivot aperture 60 is located adjacent to the top end 40 of the pennant pole. When the second end aperture 58 and the pivot aperture 60 are aligned, the pivot bolt 28 is received therethrough. The pivot bolt 28 is further received by the first end aperture 52. The pivot bolt 28 pivotally attaches the pennant pole 20 to the slide bracket 12. Additionally, receipt of the pivot bolt 28 further secures the slide bracket 12 to the structure 16 as shown in FIG. 2.

Figure 5:
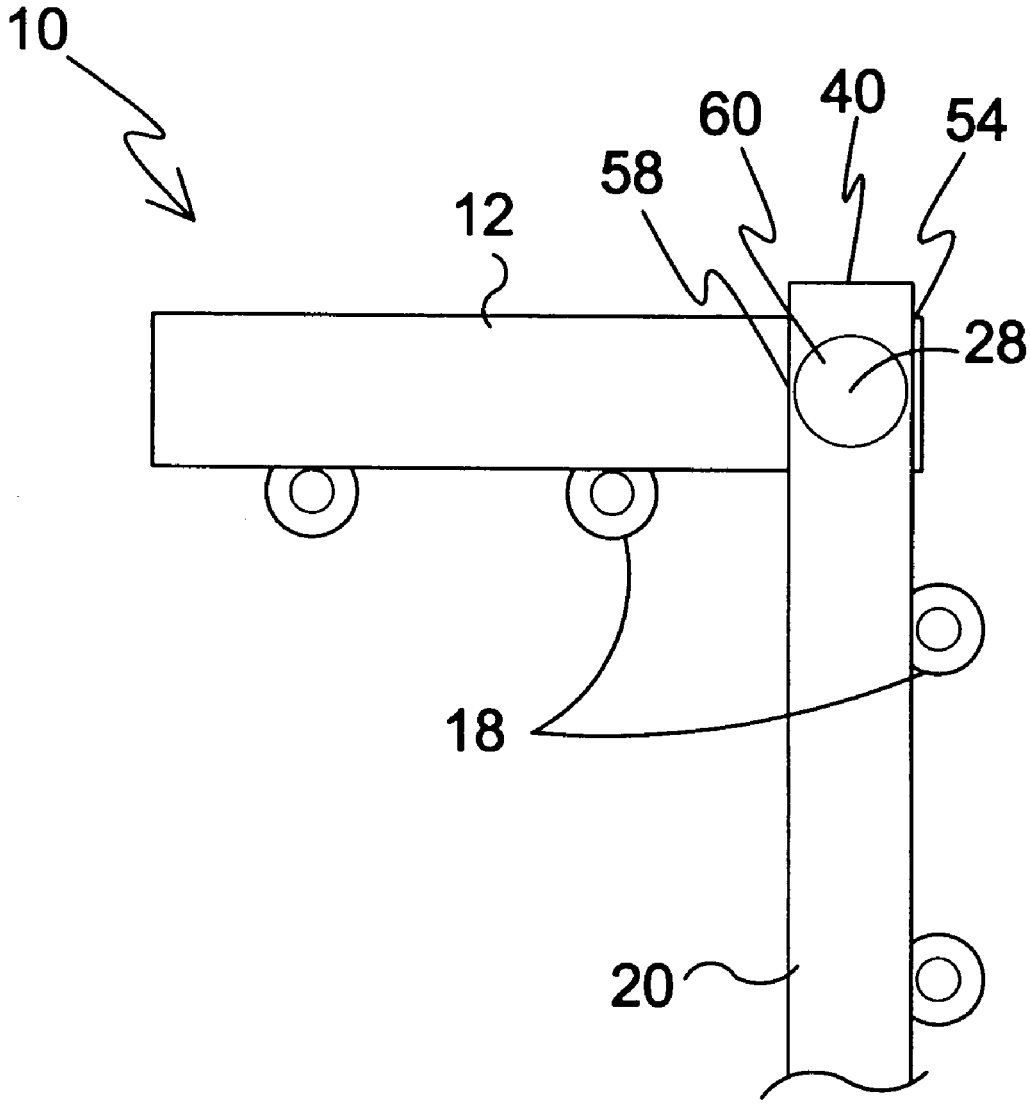
FIG. 5 is a perspective view of the side of the slide bracket of the pennant display system of the present invention.

FIG. 5 is a perspective view of the side of the slide bracket 12 of the pennant display system 10 of the present invention. The pennant display system 10 includes the slide bracket 12 pivotally attached to the pennant pole 20. The slide bracket includes the first end 52, shown in FIG. 4, and the second end 54. The second end aperture 58 is located within the second end 54 of the slide bracket. The pivot aperture 60 is located adjacent to the pennant pole top 40. When the second end aperture 58 and the pivot aperture 60 are aligned, the pivot bolt 28 is received therethrough. The pivot bolt 28 is further received by the first end aperture 52. The pivot bolt 28 pivotally attaches the pennant pole 20 to the slide bracket 12. Additionally, receipt of the pivot bolt 28 further secures the slide bracket 12 to the pennant pole 16 as shown in FIG. 2.

At least two washers 18 are located on the slide bracket 12 adjacent to the second end 54. The system 10 further includes a mechanism for pivotally connecting the pennant pole 20 to the slide bracket 12. As shown herein, the pennant pole 20 is pivotally connected adjacent to the second end 54 and is perpendicular thereto. The pennant pole 20 also includes a plurality of washers 18 extending along the pennant pole 20. As shown herein, there are at least four washers 18 disposed along the pennant pole 20 extending a predetermined distance from the pennant pole top 40. Preferably, the respective washer 18 positioned at the furthest distance from the pennant pole top 40 is positioned at a distance of no more than one quarter of the length of the pennant pole 20. This is shown for purposes of example only, and any number of washers 18 may be utilized along varied locations in different embodiments of the present invention depending on the size and type of pennant to be hung. The washer 18 on each of the slide bracket 12 and pennant pole 20 allow the pennant 22 to be connected to the structure 16 for display.

Figure 6:
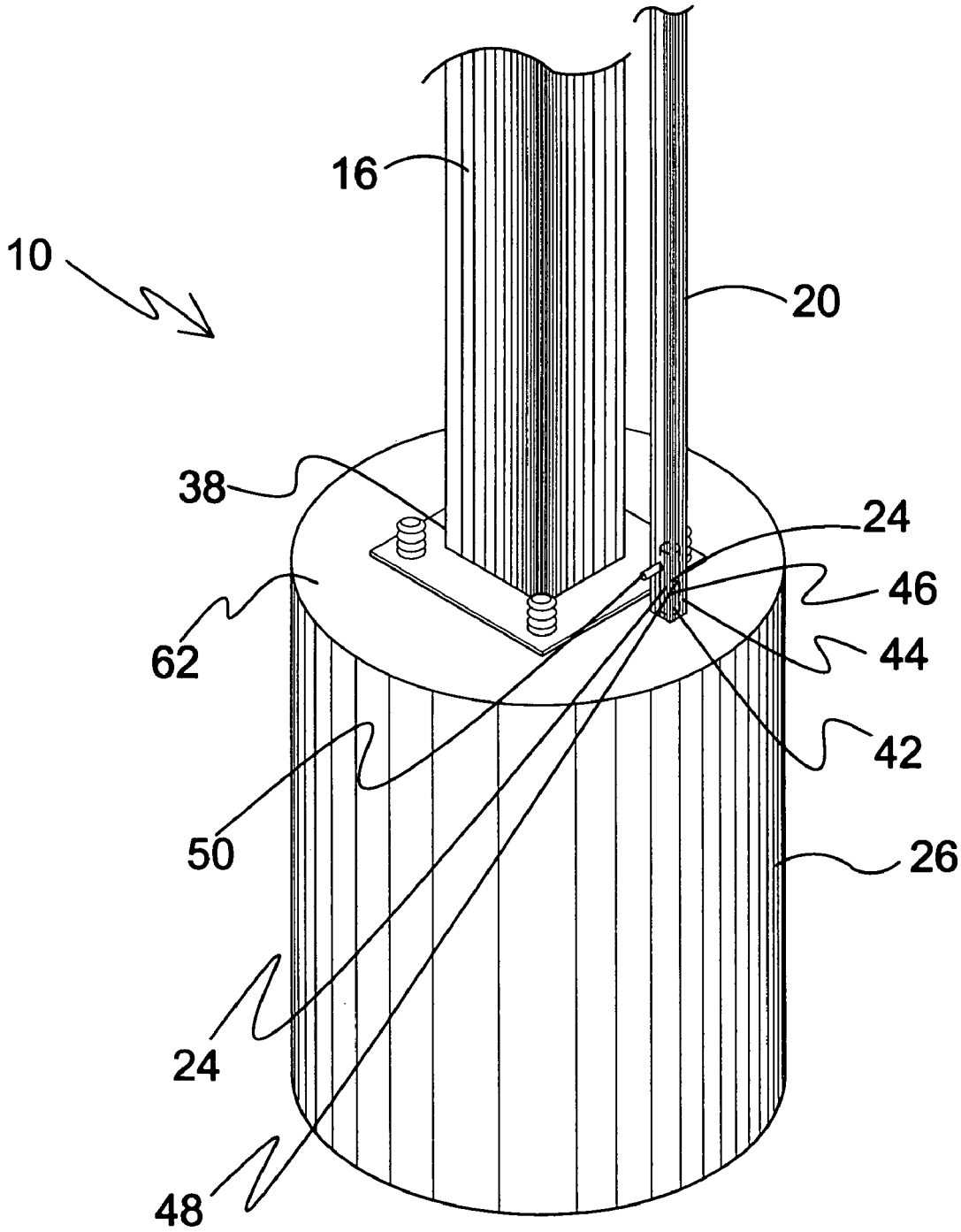
FIG. 6 is a perspective view of the pedestal of the pennant display system of the present invention.

FIG. 6 is a perspective view of the pedestal 26 of the pennant display system 10 of the present invention. The pennant display system 10 includes the slide bracket 12 pivotally attached to the pennant pole 20. Shown herein the pennant pole bottom 42 is secured to the pedestal 26 by a plate and screws. However, this is shown for purposes of example only, and the pennant pole 20 can be secured to the pedestal 26 by any number of means.

The pennant pole bottom 42 includes the locking mechanism 44 for securing the pennant pole bottom 42 to the pedestal 26. The pedestal 26 includes the top end 62. In the present embodiment, the locking mechanism 44 includes the lockable attachment pin 24 protruding upward from the pedestal top 62. The pennant pole bottom 42 has a section of one of the side of the pennant pole 20 removed therefrom. The section removed is substantially equal to a height of the lockable attachment pin 24 thereby allowing the lockable attachment pin 24 to be received within the pennant pole bottom 42 when an angle between the pennant pole top 40 and the slide bracket 12 is substantially equal to zero degrees. The lockable attachment pin 24 has the second locking aperture 48. The pennant pole 20 has the first locking aperture 46 extending through the pennant pole 20 at a predetermined distance from the pennant pole bottom 42. When the lockable attachment pin 24 is received within the pennant pole bottom 42, the first locking aperture 46 and the second locking aperture 48 are aligned. The cross pin 50 is provided and is inserted through both apertures 46 and 48 to secure the pennant pole 20 to the pedestal 26. This is shown for purposes of example only, and different mechanisms can be used to secure the pennant pole 20 to the pedestal 26.

The locking mechanism 44 prevents undesirable tampering with the pennant display system 10 as the cross pin 50 could take the form of a padlock. The locking mechanism 44 also provides a means for steadying the pennant pole 20 and keeping the pennant 22 properly displayed.

Figure 7:
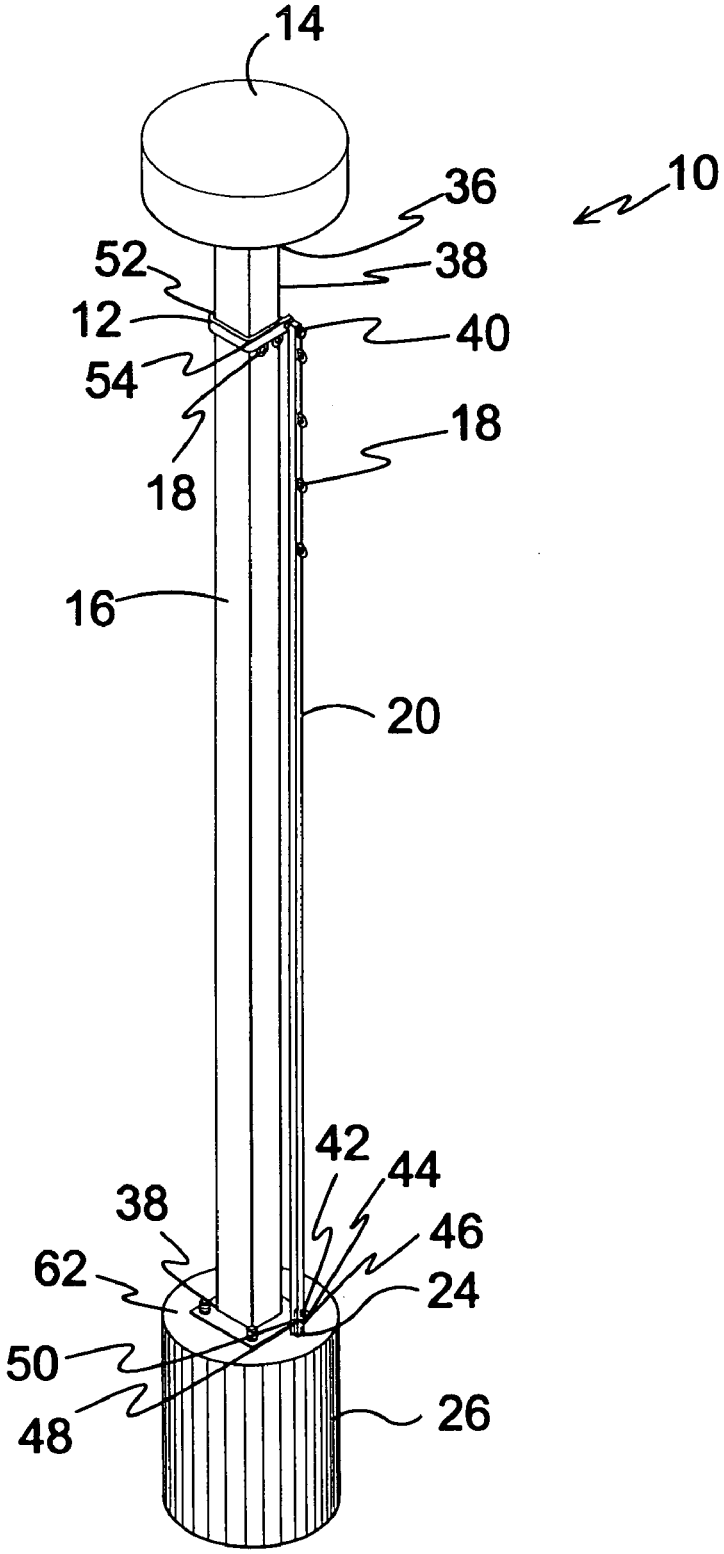
FIG. 7 is a perspective view of the pennant display system of the present invention in a fully raised position.

FIG. 7 is a perspective view of the pennant display system 10 of the present invention. The pennant display system 10 includes the slide bracket 12 pivotally attached to the pennant pole 20. The slide bracket 12 fits around the structure 16, shown in FIG. 2. Shown herein the slide bracket 12 is shaped to fit around a structure 16 shaped substantially as a square. However, the slide bracket 12 can be made in a plurality of geometric shapes to fit around a plurality of different geometrically shaped poles 16 as will be discussed hereinafter with specific reference to FIG. 11.

The structure 16 has the structure top 36 and the structure bottom 38. Shown herein, the light 14 is affixed to the structure top 36. This is shown for purposes of example only and any number of objects may be affixed to the structure top 36 in different embodiments of the invention. The structure bottom 38 is secured to the pedestal 26. The pedestal 26 is shown for purposes of example only, and the structure bottom 38 may be secured to any number of surfaces in different embodiments of the invention.

The pivot bolt 28 pivotally connects the slide bracket 12 to the pennant pole 20 at the pennant pole top 40. The slide bracket 12 in the embodiment shown herein is "C"-shaped and includes the first end 52 and the second end 54. At least two washers 18 are located on the slide bracket 12 adjacent to the second end 54. The system 10 further includes a mechanism for pivotally connecting the pennant pole 20 to the slide bracket 12 which was discussed hereinabove with specific reference to FIG. 3. As shown herein, the pennant pole 20 is pivotally connected adjacent to the second end 54 and is perpendicular thereto. The pennant pole 20 also includes the plurality of washers 18 extending along the pennant pole 20. As shown herein, there are at least four washers 18 disposed along the pennant pole 20, extending a predetermined distance from the pennant pole top 40. Preferably, the respective washer 18 positioned at the furthest distance from the pennant pole top 40 is positioned at a distance of no more than one quarter of the length of the pennant pole 20. This is shown for purposes of example only, and any number of washers 18 may be utilized along varied locations in different embodiments of the present invention depending on the size and type of pennant 22 to be hung.

The pennant pole bottom 42 includes the locking mechanism 44 for securing the pennant pole bottom 42 to the pedestal 26. The pedestal 26 includes the top end 62. In the present embodiment, the locking mechanism 44 includes the lockable attachment pin 24 protruding upward from the pedestal top 62. The pennant pole bottom 42 has a section of one of the side of the pennant pole 20 removed therefrom. The section removed is substantially equal to a height of the lockable attachment pin 24 thereby allowing the lockable attachment pin 24 to be received within the pennant pole bottom 42 when an angle between the pennant pole top 40 and the slide bracket 12 is substantially equal to zero degrees. The lockable attachment pin 24 has the second locking aperture 48. The pennant pole 20 has the first locking aperture 46 extending through the pennant pole 20 at a predetermined distance from the pennant pole bottom 42. When the lockable attachment pin 24 is received within the pennant pole bottom 42, the first locking aperture 46 and the second locking aperture 48 are aligned. The cross pin 50 is provided and is inserted through both apertures 46 and 48 to secure the pennant pole 20 to the pedestal 26. This is shown for purposes of example only, and different mechanisms can be used to secure the pennant pole 20 to the pedestal 26.

Figure 8:
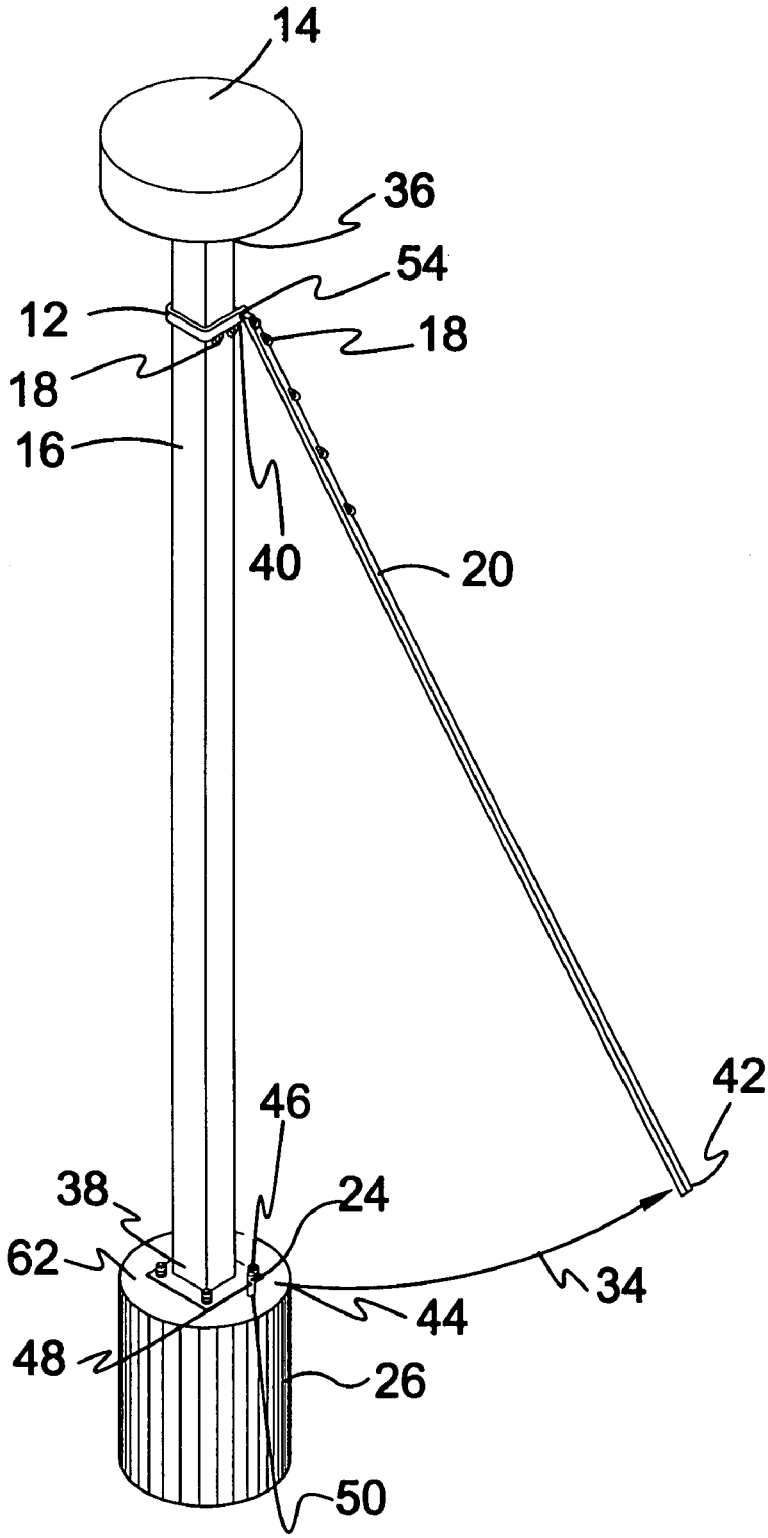
FIG. 8 is a perspective view of the pennant display system of the present invention in a fully raised position.

FIG. 8 is a perspective view of the pennant display system 10 of the present invention. The pennant display system 10 includes the slide bracket 12 pivotally attached to the pennant pole 20. The slide bracket 12 fits around the structure 16, shown in FIG. 2. Shown herein the slide bracket 12 is shaped to fit around a structure 16 shaped substantially as a square. However, the slide bracket 12 can be made in a plurality of geometric shapes to fit around a plurality of different geometrically shaped poles 16 as will be discussed hereinafter with specific reference to FIG. 11.

The structure 16 has the structure top 36 and the structure bottom 38. Shown herein, the light 14 is affixed to the structure top 36. This is shown for purposes of example only and any number of objects may be affixed to the structure top 36 in different embodiments of the invention. The structure bottom 38 is secured to the pedestal 26. The pedestal 26 is shown for purposes of example only, and the structure bottom 38 may be secured to any number of surfaces in different embodiments of the invention.

The pivot bolt 28 pivotally connects the slide bracket 12 to the pennant pole 20 at the pennant pole top 40. The slide bracket 12 in the embodiment shown herein is "C"-shaped and includes the first end 52 and the second end 54. At least two washers 18 are located on the slide bracket 12 adjacent to the second end 54. The system 10 further includes a mechanism for pivotally connecting the pennant pole 20 to the slide bracket 12 which was discussed hereinabove with specific reference to FIG. 3. As shown herein, the pennant pole 20 is pivotally connected adjacent to the second end 54 and is perpendicular thereto. The pennant pole 20 also includes the plurality of washers 18 extending along the pennant pole 20. As shown herein, there are at least four washers 18 disposed along the pennant pole 20, extending a predetermined distance from the pennant pole top 40. Preferably, the respective washer 18 positioned at the furthest distance from the pennant pole top 40 is positioned at a distance of no more than one quarter of the length of the pennant pole 20. This is shown for purposes of example only, and any number of washers 18 may be utilized along varied locations in different embodiments of the present invention depending on the size and type of pennant 22 to be hung.

The pennant pole bottom 42 includes the locking mechanism 44 for securing the pennant pole bottom 42 to the pedestal 26. The pedestal 26 includes the top end 62. In the present embodiment, the locking mechanism 44 includes the lockable attachment pin 24 protruding upward from the pedestal top 62. The pennant pole bottom 42 has a section of one of the side of the pennant pole 20 removed therefrom. The section removed is substantially equal to a height of the lockable attachment pin 24 thereby allowing the lockable attachment pin 24 to be received within the pennant pole bottom 42 when an angle between the pennant pole top 40 and the slide bracket 12 is substantially equal to zero degrees. The lockable attachment pin 24 has the second locking aperture 48. The pennant pole 20 has the first locking aperture 46 extending through the pennant pole 20 at a predetermined distance from the pennant pole bottom 42. When the lockable attachment pin 24 is received within the pennant pole bottom 42, the first locking aperture 46 and the second locking aperture 48 are aligned. The cross pin 50 is provided and is inserted through both apertures 46 and 48 to secure the pennant pole 20 to the pedestal 26. This is shown for purposes of example only, and different mechanisms can be used to secure the pennant pole 20 to the pedestal 26.

As shown herein the pennant pole 20 pivots about the pivot bolt 28 as indicated by an arc arrow 34. Movement according to arc 34 increases the angle between the pennant pole 20 and the slide bracket 12. Creation of the angle provides a user 30 with leverage to exert a downward force on pennant pole 20. The ability to exert this downward force increases an ease of which the slide bracket 12 can be moved along the height of the structure 16. As shown herein, the force is allowing the slide bracket 12 to be moved in a downward direction towards the pedestal 26 which is indicated by the arrows labeled with reference number 32. The pivoting around the pivot bolt 28 makes it easier for the pennant pole 20 to pull the slide bracket 12 down the structure 16 or to push the slide bracket 12 up the structure 16.

Figure 9:
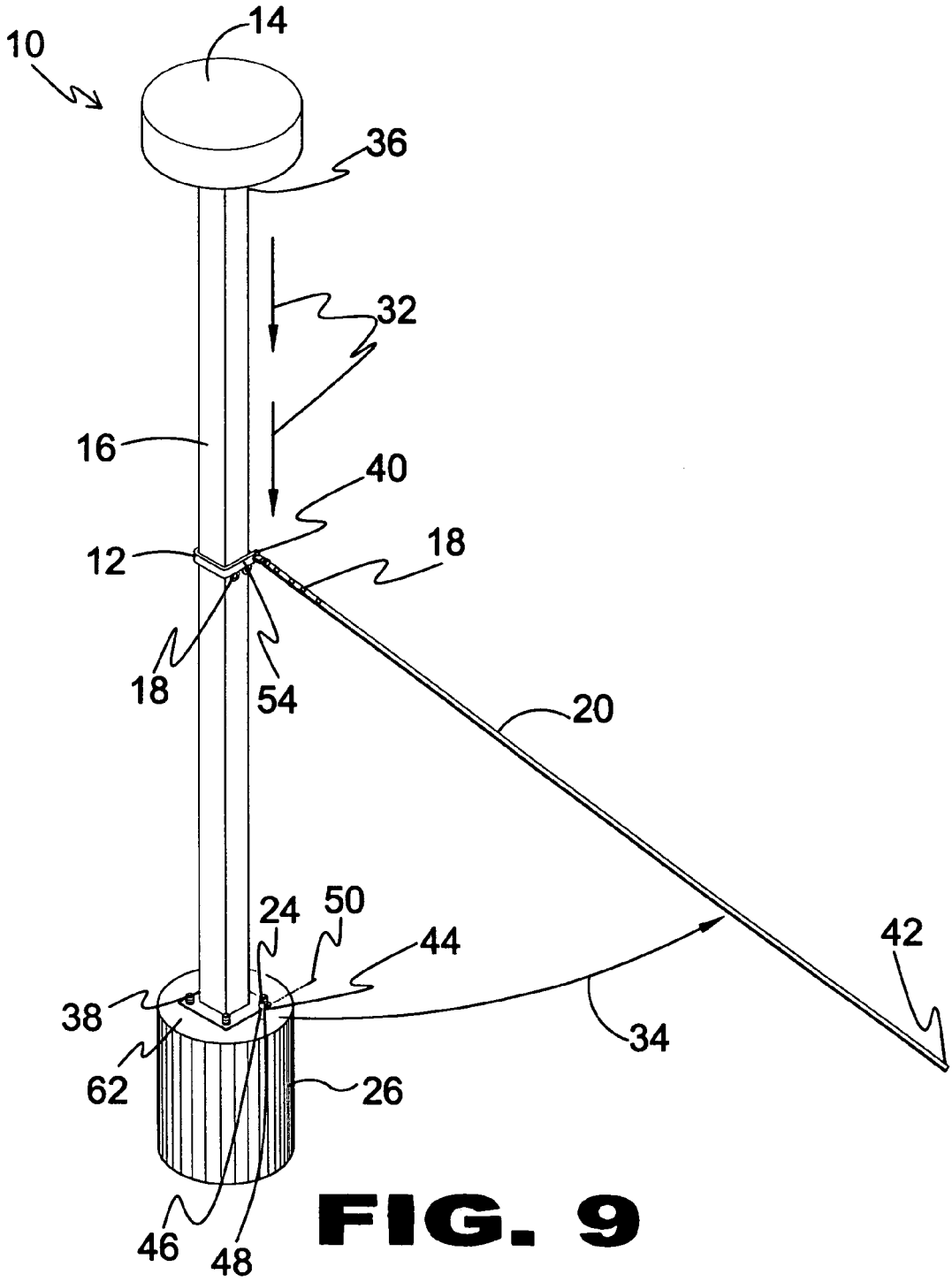
FIG. 9 is a perspective view of the pennant display system of the present invention in a partially lowered position.

FIG. 9 is a perspective view of the pennant display system 10 in a partially lowered position. The pennant display system 10 includes the slide bracket 12 pivotally attached to the pennant pole 20. The slide bracket 12 fits around the structure 16, shown in FIG. 2. Shown herein the slide bracket 12 is shaped to fit around a structure 16 shaped substantially as a square. However, the slide bracket 12 can be made in a plurality of geometric shapes to fit around a plurality of different geometrically shaped poles 16 as will be discussed hereinafter with specific reference to FIG. 11.

The structure 16 has the structure top 36 and the structure bottom 38. Shown herein, the light 14 is affixed to the structure top 36. This is shown for purposes of example only and any number of objects may be affixed to the structure top 36 in different embodiments of the invention. The structure bottom 38 is secured to the pedestal 26. The pedestal 26 is shown for purposes of example only, and the structure bottom 38 may be secured to any number of surfaces in different embodiments of the invention.

The pivot bolt 28 pivotally connects the slide bracket 12 to the pennant pole 20 at the pennant pole top 40. The slide bracket 12 in the embodiment shown herein is "C"-shaped and includes the first end 52 and the second end 54. At least two washers 18 are located on the slide bracket 12 adjacent to the second end 54. The system 10 further includes a mechanism for pivotally connecting the pennant pole 20 to the slide bracket 12 which was discussed hereinabove with specific reference to FIG. 3. As shown herein, the pennant pole 20 is pivotally connected adjacent to the second end 54 and is perpendicular thereto. The pennant pole 20 also includes the plurality of washers 18 extending along the pennant pole 20. As shown herein, there are at least four washers 18 disposed along the pennant pole 20, extending a predetermined distance from the pennant pole top 40. Preferably, the respective washer 18 positioned at the furthest distance from the pennant pole top 40 is positioned at a distance of no more than one quarter of the length of the pennant pole 20. This is shown for purposes of example only, and any number of washers 18 may be utilized along varied locations in different embodiments of the present invention depending on the size and type of pennant 22 to be hung.

The pennant pole bottom 42 includes the locking mechanism 44 for securing the pennant pole bottom 42 to the pedestal 26. The pedestal 26 includes the top end 62. In the present embodiment, the locking mechanism 44 includes the lockable attachment pin 24 protruding upward from the pedestal top 62. The pennant pole bottom 42 has a section of one of the side of the pennant pole 20 removed therefrom. The section removed is substantially equal to a height of the lockable attachment pin 24 thereby allowing the lockable attachment pin 24 to be received within the pennant pole bottom 42 when an angle between the pennant pole top 40 and the slide bracket 12 is substantially equal to zero degrees. The lockable attachment pin 24 has the second locking aperture 48. The pennant pole 20 has the first locking aperture 46 extending through the pennant pole 20 at a predetermined distance from the pennant pole bottom 42. When the lockable attachment pin 24 is received within the pennant pole bottom 42, the first locking aperture 46 and the second locking aperture 48 are aligned. The cross pin 50 is provided and is inserted through both apertures 46 and 48 to secure the pennant pole 20 to the pedestal 26. This is shown for purposes of example only, and different mechanisms can be used to secure the pennant pole 20 to the pedestal 26.

As shown herein the pennant pole 20 is able to move about the pivot bolt 28 as indicated by an arc arrow 34 and the angle described in FIG. 8 has increased. This increased angle further increases the leverage of the user 30 and reduces the force needed to cause the slide bracket 12 to move. Also shown herein, the pennant pole 20 has pulled the slide bracket 12 in a downward direction, as indicated by the down arrows 32.

Figure 10:
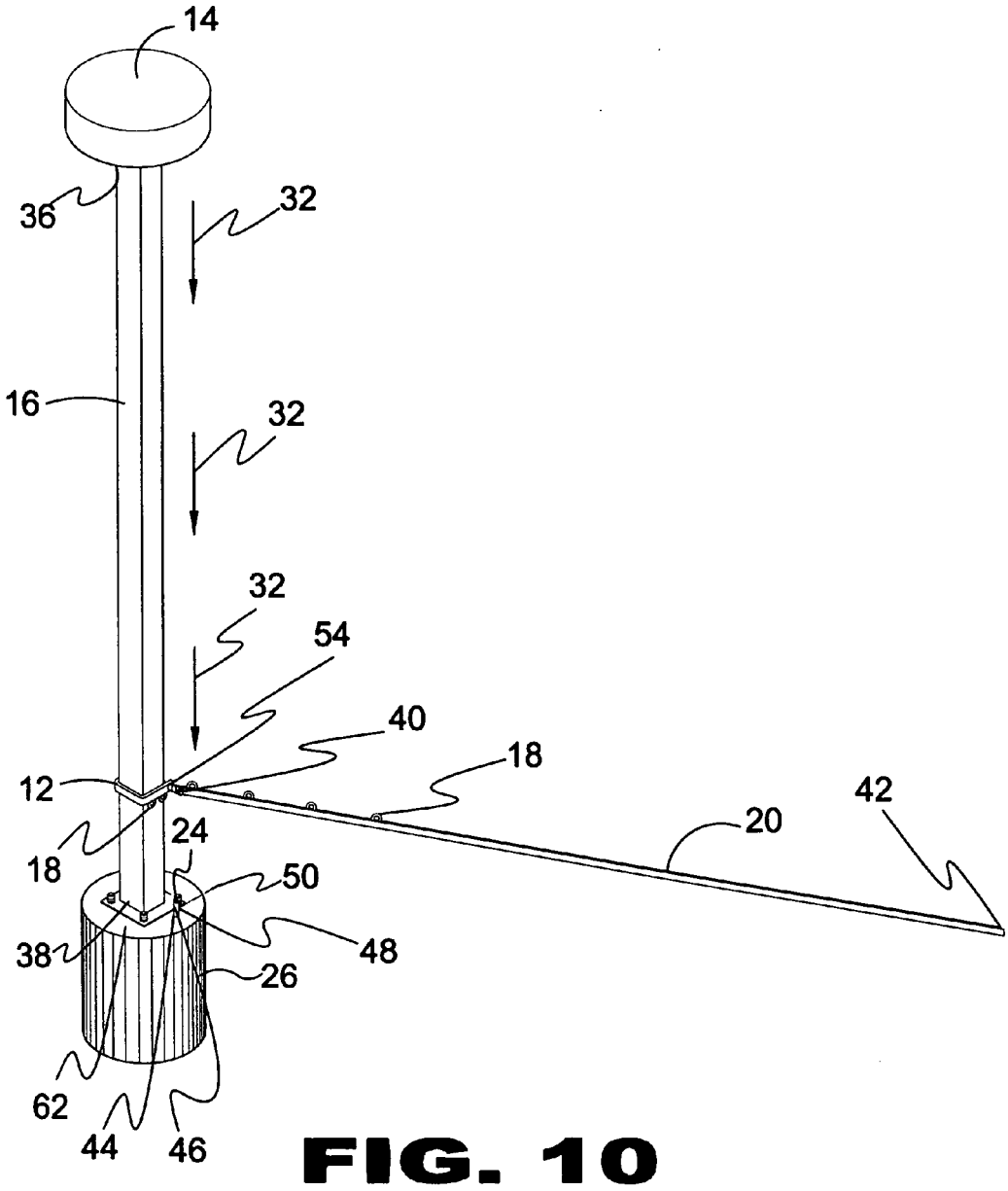
FIG. 10 is a perspective view of the pennant display system of the present invention in a fully lowered position.

FIG. 10 is a perspective view of the pennant display system 10 of the present invention in the fully lowered position. The pennant display system 10 includes the slide bracket 12 pivotally attached to the pennant pole 20. The slide bracket 12 fits around the structure 16, shown in FIG. 2. Shown herein the slide bracket 12 is shaped to fit around a structure 16 shaped substantially as a square. However, the slide bracket 12 can be made in a plurality of geometric shapes to fit around a plurality of different geometrically shaped poles 16 as will be discussed hereinafter with specific reference to FIG. 11.

The structure 16 has the structure top 36 and the structure bottom 38. Shown herein, the light 14 is affixed to the structure top 36. This is shown for purposes of example only and any number of objects may be affixed to the structure top 36 in different embodiments of the invention. The structure bottom 38 is secured to the pedestal 26. The pedestal 26 is shown for purposes of example only, and the structure bottom 38 may be secured to any number of surfaces in different embodiments of the invention.

The pivot bolt 28 pivotally connects the slide bracket 12 to the pennant pole 20 at the pennant pole top 40. The slide bracket 12 in the embodiment shown herein is "C"-shaped and includes the first end 52 and the second end 54. At least two washers 18 are located on the slide bracket 12 adjacent to the second end 54. The system 10 further includes a mechanism for pivotally connecting the pennant pole 20 to the slide bracket 12 which was discussed hereinabove with specific reference to FIG. 3. As shown herein, the pennant pole 20 is pivotally connected adjacent to the second end 54 and is perpendicular thereto. The pennant pole 20 also includes the plurality of washers 18 extending along the pennant pole 20. As shown herein, there are at least four washers 18 disposed along the pennant pole 20, extending a predetermined distance from the pennant pole top 40. Preferably, the respective washer 18 positioned at the furthest distance from the pennant pole top 40 is positioned at a distance of no more than one quarter of the length of the pennant pole 20. This is shown for purposes of example only, and any number of washers 18 may be utilized along varied locations in different embodiments of the present invention depending on the size and type of pennant 22 to be hung.

The pennant pole bottom 42 includes the locking mechanism 44 for securing the pennant pole bottom 42 to the pedestal 26. The pedestal 26 includes the top end 62. In the present embodiment, the locking mechanism 44 includes the lockable attachment pin 24 protruding upward from the pedestal top 62. The pennant pole bottom 42 has a section of one of the side of the pennant pole 20 removed therefrom.

The section removed is substantially equal to a height of the lockable attachment pin 24 thereby allowing the lockable attachment pin 24 to be received within the pennant pole bottom 42 when an angle between the pennant pole top 40 and the slide bracket 12 is substantially equal to zero degrees. The lockable attachment pin 24 has the second locking aperture 48. The pennant pole 20 has the first locking aperture 46 extending through the pennant pole 20 at a predetermined distance from the pennant pole bottom 42. When the lockable attachment pin 24 is received within the pennant pole bottom 42, the first locking aperture 46 and the second locking aperture 48 are aligned. The cross pin 50 is provided and is inserted through both apertures 46 and 48 to secure the pennant pole 20 to the pedestal 26. This is shown for purposes of example only, and different mechanisms can be used to secure the pennant pole 20 to the pedestal 26.

As shown herein the pennant pole 20 has pivoted about the pivot bolt 28 so that the pennant pole 20 is substantially equivalent to 180 degrees with the second end 54 of the slide bracket 12. In this position, the pennant pole 20 has pulled the slide bracket 12 in a downward direction, as indicated by the down arrows 32, so that it is fully lowered and near the pole bottom 38. In the fully lowered position, the pennant 22, shown in FIG. 2, can be easily attached, removed, adjusted or replaced.

Figure 11:
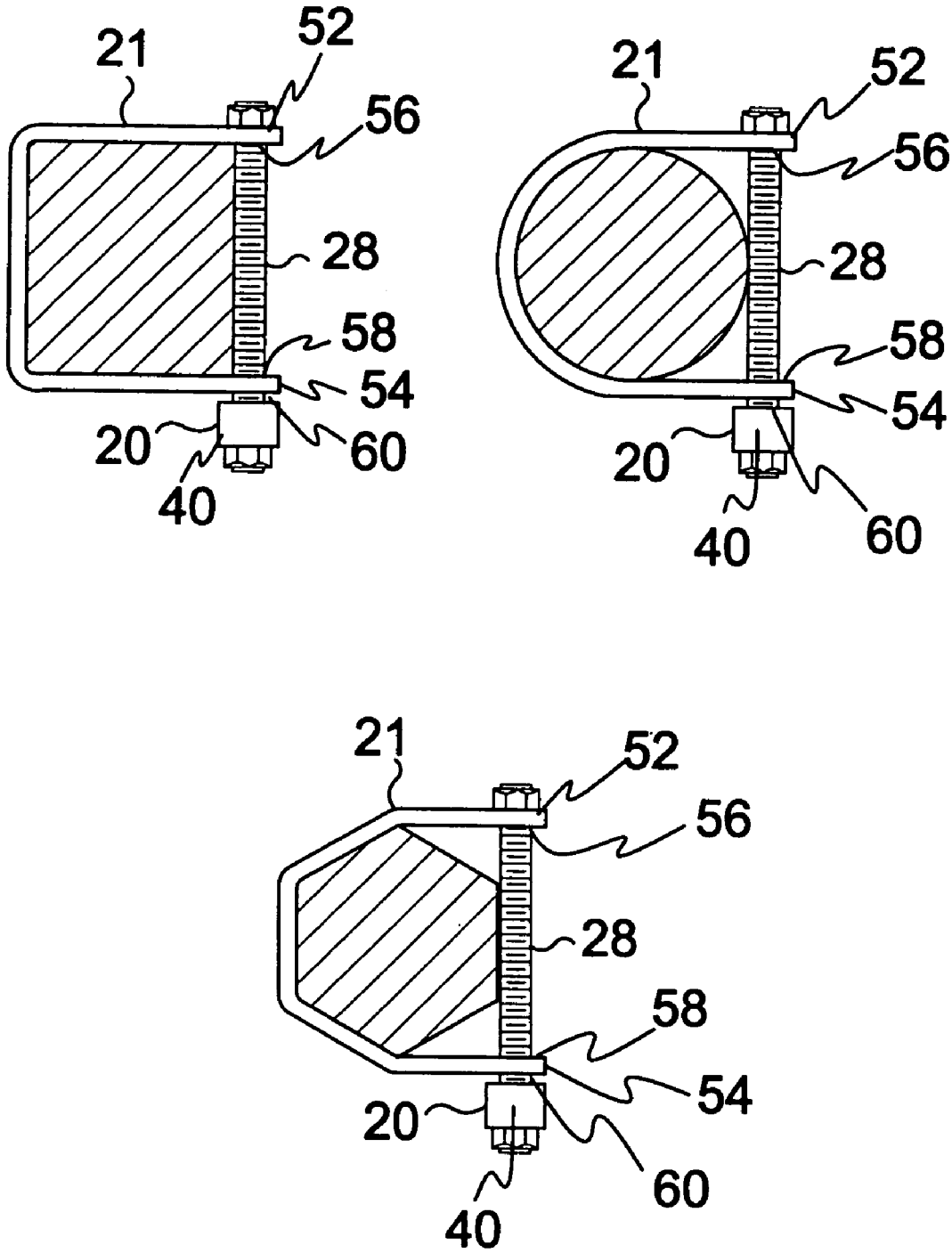
FIG. 11 is a top view of the pennant display system of the present invention's various slide bracket shape.

FIG. 11 is a top view of a plurality of embodiments of the slide bracket 12 of the pennant display system 10 of the present claimed invention. The pennant display system 10 includes the slide bracket 12 pivotally attached to the pennant pole 20. The slide bracket 12 fits around the structure 16, shown in FIG. 2. Shown herein the slide bracket 12 is shaped to fit around differently shaped structures 16. The slide bracket 12 can be made in a plurality of geometric shapes to fit around a plurality of different geometrically shaped structures 16. For example, when the structure 16 is squarely shaped, the slide bracket 12 is also shaped substantially as a square to fit around the structure 16. When the structure 16 is substantially round in shape, the slide bracket 12 is substantially round in shape to fit around the structure 16. When the structure 16 is shaped substantially as a hexagon, the slide bracket 12 is shaped substantially as a hexagon to fit around the structure 16.

The slide bracket includes the first end 52 and the second end 54. The first end 52 of the slide bracket includes the first end aperture 56. The second end 54 of the slide bracket includes the second end aperture 58. The pivot aperture 60 is located adjacent to the top end 40 of the pennant pole. When the second end aperture 54 and the pivot aperture 60 are aligned, the pivot bolt 28 is received therethrough. The pivot bolt 28 is further received by the first end aperture 52. The pivot bolt 28 pivotally attaches the pennant pole 20 to the slide bracket 12. Additionally, receipt of the pivot bolt 28 further secures the slide bracket 12 to the structure 16 as shown in FIG. 2.

It will be understood that each of the elements described above, or two or more together may also find a useful application in other types of devices differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by letters Patent is set forth in the appended claims:

1. A pennant display system comprising:

a) a cuff positioned on a structure having predetermined height;

b) means connected to said cuff for moving said cuff along said height;

c) means positioned on each of said cuff and said moving means for releaseably attaching a pennant thereto;

d) means positioned on a base of said structure for securing said moving means to said structure; and wherein said securing means comprises:

e) A post having a hole extending transversely therethrough;

f) A recess in said moving means positioned at an end opposite said connection with said cuff;

g) At least one aperture extending through said moving means; and h) A locking pin, wherein said moving means is moveable for receiving said post within said recess thereby causing said at least one aperture to be aligned with said channel and said locking pin is receiveable through said at least one aperture and said channel for releasably securing said moving means to said structure.

2. The system as recited in claim 1, wherein said moving means is pivotally connected to said cuff for providing leverage to move said cuff along said height of said structure.

3. The system as recited in claim 2, wherein said moving means is moveable from a first secured position to a second unsecured position by pivoting about a pivot point connecting said moving means to said cuff.

4. The system as recited in claim 3, wherein in said first secured position said moving means is substantially parallel to said structure.

5. The system as recited in claim 4, wherein upon said moving means entering said second unsecured position, an angle is created at said pivot point between said moving means and said structure.

6. The system as recited in claim 5, wherein in said second unsecured position said angle ranges between substantially zero degrees and substantially ninety degrees.

7. The system as recited in claim 6, wherein upon increasing said angle towards ninety degrees, an amount of leverage associated therewith increases thereby allowing said cuff to move by applying a decreased amount of force.

8. The system as recited in claim 7, wherein said amount of force is inversely proportional to said amount of leverage.

9. The system as recited in claim 1, wherein said cuff includes a first aperture extending transversely through a first distal end thereof and a second aperture extending transversely through a second distal end thereof opposite said first distal end, wherein said first aperture is aligned with said second aperture.

10. The system as recited in claim 9, wherein said moving means is a pole having a third aperture extending transversely through a first distal end thereof.

11. The system as recited in claim 10, wherein further comprising a bolt for receipt though each of said first, second and third apertures for connecting said pole to said cuff and further securing said cuff to said structure.

12. The system as recited in claim 11, wherein upon connecting said pole to said cuff, said pole is able to selectively pivot about said bolt to allow a user to move said cuff along said height of said structure.

13. The system as recited in claim 1, wherein said attaching means are a plurality of washers positioned at predetermined locations along each of said cuff and said moving means.

14. The system as recited in claim 1, wherein said cuff includes an inner perimeter having a shape substantially similar to a shape of said structure.

15. The system as recited in claim 1, wherein said cuff is substantially C shaped.

16. The system as recited in claim 1, wherein said cuff has a curvilinear portion.

* * * * *